US006570030B2

(12) United States Patent
Goto et al.

(10) Patent No.: US 6,570,030 B2
(45) Date of Patent: May 27, 2003

(54) METHOD FOR PREPARING FATTY ACID ESTERS FROM SEEDS OR FRUITS

(75) Inventors: Fumisato Goto, Tsukuba (JP); Toshio Sasaki, Ichihara (JP)

(73) Assignee: Sumitomo Chemical Company, Limited, Osaka (JP)

( * ) Notice: Subject to any disclaimer, the term of this patent is extended or adjusted under 35 U.S.C. 154(b) by 0 days.

(21) Appl. No.: 10/014,591

(22) Filed: Dec. 14, 2001

(65) Prior Publication Data

US 2002/0077492 A1 Jun. 20, 2002

(30) Foreign Application Priority Data

Dec. 15, 2000 (JP) ..... 2000-381724

(51) Int. Cl.[7] ..... C11C 1/00
(52) U.S. Cl. ..... 554/167; 554/169
(58) Field of Search ..... 554/169, 167

(56) References Cited

U.S. PATENT DOCUMENTS 6,288,251 B1 * 9/2001 Tsuto et al. ..... 554/169

FOREIGN PATENT DOCUMENTS

| | | | |
|---|---|---|---|
| JP | 2235995 | A | 9/1990 |
| JP | 6-136384 | | 5/1994 |
| JP | 2000-143586 | | 5/2000 |
| WO | WO9738069 | A1 | 10/1997 |
| WO | WO0005395 | A1 | 2/2000 |
| WO | WO0020541 | A1 | 4/2000 |

* cited by examiner

*Primary Examiner*—Deborah D. Carr
(74) *Attorney, Agent, or Firm*—Birch, Stewart, Kolasch & Birch, LLP

(57) ABSTRACT

A fatty acid ester prepared by treating botanical seeds or fruits with a monohydric alcohol having 1 to 10 carbon atoms under pressure at a temperature of at least 180° C., preferably under supercritical conditions.

7 Claims, No Drawings

METHOD FOR PREPARING FATTY ACID ESTERS FROM SEEDS OR FRUITS

BACKGROUND OF THE INVENTION

1. Field of the Invention

The present invention relates to a method for preparing fatty acid esters which are esters of fatty acids from botanical seeds and/or fruits with a monohydric alcohol (hereinafter sometimes referred to as "fatty acid esters").

2. Prior Art

Esters of fatty acids with monohydric alcohols are widely used as raw materials in the production of surfactants. Furthermore, such esters are used as diesel fuel as alternates for gas oil.

In general, fatty acid esters are prepared by reacting fats and oils (fatty acid triglycerides), which are extracted from botanical seeds and fruits, with monohydric alcohols.

The extraction of fats and oils from the botanical seeds and fruits require a complicated multi-step oil-bearing process comprising an expression step, an extraction step with solvents, a purification step, etc. JP-A-6-136384 discloses a process for extracting fats and oils from perilla (*Perilla ocimoides*) using a fluid in a supercritical state in an oil collection process, that is, supercritical state $CO_2$ at a temperature of 40° C. under a pressure of 400 kg/cm$^2$. However, the products obtained are fats and oils, and thus the fats and oils should be mixed with a monohydric alcohol to effect a transesterification reaction to obtain fatty acid esters.

A method for preparing fatty acid esters through the transesterification by reacting fats and oils with monohydric alcohols is known. For example, JP 2000-143586 A discloses a method for preparing fatty acid esters comprising reacting fats and oils with a monohydric alcohol under conditions where the fats and oils and/or the monohydric alcohol are in the supercritical state. However, the fats and oils used in this method are obtained by a complicated process such as the extraction of fats and oils from botanical seeds and fruits.

SUMMARY OF THE INVENTION

An object of the present invention is to provide a method for preparing fatty acid esters from botanical seeds and fruits by a simple process.

This and other objects can be achieved by a method for preparing a fatty acid ester comprising treating at least one of botanical seeds and fruits with a monohydric alcohol of the formula:

$$R—OH \quad (1)$$

wherein R is an alkyl group having 1 to 10 carbon atoms under pressure at a temperature of at least 180° C.

The method of the present invention for preparing fatty acid esters, which is greatly simplified in comparison with the prior art methods, has been completed based on the finding that, when the botanical seeds and/or fruits are treated with the monohydric alcohol under pressure at a temperature of at least 180° C., the extraction of fats and oils from the seeds and/or fruits and the formation of the fatty acid esters through the reaction of the extracted fats and oils with the alcohol proceed in one step.

DETAILED DESCRIPTION OF THE INVENTION

The botanical seeds to be used as the raw materials in the method of the present invention may be any seeds containing fats and oils. Examples of such seeds include seeds of soybean, rape plant, kenaf, sunflower, grape, rice, cotton, safflower, castor, sesame, camellia, mustard, peanut, corn, flax, coconut, apricot, perilla, paulownia, chaulmoogra, etc. Among them, the seeds of soybean, rape plant and kenaf are preferable. Those seeds may be used singly or in admixture. In particular, the seeds of kenaf are preferable in view of quick growth.

The botanical fruits to be used as the raw materials in the method of the present invention may be any fruits containing fats and oils. Examples of such fruits include fruits of olive, palm, etc. Those fruits may be used singly or in admixture.

The fats and oils contained in the botanical seeds or fruits are synthesized by plants from carbon dioxide in an air, and the fatty acid esters produced from such fats and oil can be used as a diesel fuel and the combustion of the fatty acid esters generates carbon dioxide. Accordingly, carbon dioxide in the air can be recycled when the fatty acid esters are used as a fuel, and thus the fatty acid esters attract attentions as the diesel fuel which can suppress the increase of carbon dioxide in the global environment. Thus, the present invention also provide a method for producing a diesel fuel, which is suitable as a measure to suppress the amount of carbon dioxide in the air for the prevention of global warming, by simplified steps in comparison with the conventional method.

In the method of the present invention, the botanical seeds and fruits can be used as such, while damaged or deformed ones may be used. In the case of fruits containing seeds therein, the fruits containing seeds as such can be used, or only the flesh of the fruits may be used after removing the seeds. Before being used as the raw materials in the method of the present invention, the seeds and/or fruits may be subjected to a pretreatment such as expression, depression, peeling, cutting, heating, pressurizing, drying, etc.

In the alcohol of the formula (1), which is the other raw material, R is an alkyl group having 1 to 10 carbon atoms, preferably 1 to 4 carbon atoms. The alkyl group may be a linear, branched or cyclic group.

Specific examples of the monohydric alcohol include methanol, ethanol, n-propanol, isopropanol, n-butanol, isobutanol, 2-butanol, tert.-butanol, n-pentanol, n-hexanol, cyclohexanol, n-heptanol, n-octanol, n-nonanol, n-decanol, etc. Among them, methanol, ethanol, n-propanol, isopropanol, n-butanol, isobutanol, 2-butanol and tert.-butanol are preferable, and methanol and ethanol are more preferable. In particular, methanol is preferable. Those alcohols may be used singly or in admixture.

A weight ratio of the alcohol of the formula (1) to the botanical seeds and/or fruits is usually from 0.01:1 to 100:1, preferably from 0.03:1 to 50:1, more preferably from 0.05:1 to 20:1, particularly preferably from 0.1:1 to 5:1.

Typical but non-limiting examples of the fatty acid esters to be produced by the method of the present invention include esters of caprylic acid, capric acid, lauric acid, myristic acid, palmitic acid, stearic acid, arachidic acid, behenic acid, lignoceric acid, hexadecenoic acid, oleic acid, eicosenoic acid, erucic acid, linoleic acid, linolenic acid, ricinoleic acid, etc.

The kind of the alcohol moiety of the fatty acid esters depends on the monohydric alcohol used. For example, when methanol is used as the monohydric alcohol, methyl esters are obtained, and when ethanol is used as the monohydric alcohol, ethyl esters are obtained.

The method of the present invention is characterized in that the treatment is carried out under pressure at a temperature of at least 180° C.

When the temperature is lower than 180° C., the extraction of the fats and oils from the seeds and/or fruits and the transesterification of the fats and oils may hardly proceed. The pressure in the method is usually higher than the atmospheric pressure, and is preferably at least 2 MPa for the acceleration of the extraction and transesterification of the fats and oils. More preferable treatment conditions are those under which the monohydric alcohol of the formula (1) is in the supercritical state.

A supercritical state is now explained.

A material has specific three states, that is, a gas state, a liquid state and a solid state. Furthermore, a temperature exceeds a supercritical temperature, the gas state and the liquid state cannot be distinguished and a material has a fluid state in which it is not condensed by the application of pressure. Such a state of a material is a supercritical state, and a material in the supercritical state is called a supercritical fluid.

A supercritical fluid has different properties from those of a liquid or a gas. The supercritical fluid has a density close to that of a liquid, a viscosity close to that of a gas and a thermal conductivity and diffusion coefficient inbetween those of a gas and a liquid. Thus, the supercritical fluid functions as "a non-liquid solvent", and may accelerate the extraction and reaction due to its high density, low viscosity and high diffusivity and cause the extraction and reaction at the same time. However, the mechanisms of the above have not been clarified.

In addition, since the supercritical fluid has a density close to that in the liquid state, its use can reduce the volume of a reactor in comparison with a gas phase reaction.

The heating condition to achieve the supercritical state of a monohydric alcohol will be explained.

When methanol is used as a monohydric alcohol, the heating is carried out at a temperature of at least 239° C. under a pressure of at least 8.0 MPa, since methanol has a critical temperature of 239° C. and a critical pressure of 8.0 MPa. When ethanol is used as a monohydric alcohol, the heating is carried out at a temperature of at least 241° C. under a pressure of at least 6.1 MPa, since ethanol has a critical temperature of 241° C. and a critical pressure of 6.1 MPa. When n-propanol is used as a monohydric alcohol, the heating is carried out at a temperature of at least 264° C. under a pressure of at least 5.2 MPa, since n-propanol has a critical temperature of 264° C. and a critical pressure of 5.2 MPa. When n-butanol is used as a monohydric alcohol, the heating is carried out at a temperature of at least 290° C. under a pressure of at least 4.4 MPa, since n-butanol has a critical temperature of 290° C. and a critical pressure of 4.4 MPa.

Preferably, the heating temperature does not exceed 500° C., more preferably 450° C., particularly preferably 400° C. to suppress side reactions.

Preferably, the pressure during heating does not exceed 25 MPa, more preferably 20 MPa.

The heating time is usually from 1 minute to 24 hours.

The reaction in the method of the present invention proceeds effectively in the absence of a catalyst, while it is possible to use a catalyst to further increase the efficiency of the method. Any catalyst that can increase the reaction efficiency may be used. Preferred examples of the catalyst include metal oxides, and hydroxides, carbonates, hydrogen carbonates and carboxylates of alkali metals since they achieve a high reaction rate. More preferably, the hydroxides and carbonates of the alkali metals are used.

Specific examples of the metal oxides include MgO, CaO, SrO, BaO, ZnO, $SiO_2$, $GeO_2$, $SnO_2$, CuO, $WO_3$, $MnO_2$, $MoO_3$, etc. Among them, MgO, CaO, SrO and BaO are preferable. Specific examples of the alkali metal hydroxides include LiOH, NaOH, KOH, RbOH and CsOH. Specific examples of the alkali metal carbonates include $Li_2CO_3$, $Na_2CO_3$, $K_2CO_3$, $Rb_2CO_3$ and $Cs_2CO_3$. Specific examples of the alkali metal hydrogen carbonates include $LiHCO_3$, $NaHCO_3$, $KHCO_3$, $RbHCO_3$ and $CsHCO_3$. Specific examples of the alkali metal carboxylates include lithium acetate, sodium acetate, potassium acetate, rubidium acetate, cesium acetate, sodium formate, potassium formate, sodium propionate, potassium propionate, sodium oxalate, potassium oxalate, etc.

The amount of the catalyst used depends on the mode and scale of the reaction, and is usually from 0.001 to 10% by weight, preferably from 0.01 to 5% by weight, more preferably from 0.1 to 2% by weight, based on the weight of the seeds and/or fruits.

The method of the present invention may be carried out in various ways. For example, it can be carried out in a batch system or a continuous flow system.

The crude product obtained by the method of the present invention may contain glycerin, unreacted monohydric alcohol, intermediates, impurities and/or solid components in addition to the fatty acid esters and the residues of the botanical seeds and/or fruits. Thus, the desired fatty acid esters are recovered from the crude products and purified. To this end, any conventional method such as filtration, distillation, extraction, etc. may be used depending on the properties of the fatty acid esters to be recovered and purified.

According to the present invention, the fatty acid esters can be produced from the botanical seeds and/or fruits and a monohydric alcohol of the formula (1) by the simple method.

EXAMPLES

The present invention will be explained in detail by the following Examples, which do not limit the scope of the invention in any way.

The weights of the products in the Examples were calculated from the peak areas according to size exclusion chromatography (SEC). PLgel Mixed-E (7.5 mmϕ×30 cmL) was used as a column, tetrahydrofuran was flowed at a flow rate of 0.5 cc/min. as a mobile phase, and a differential refractive index detector was used as a detector.

The formation of the fatty acid esters was confirmed with a gas chromatography-mass spectrometer consisting of HP-6890 (GC: manufactured by Hewlett-Packard) and HP-5973 (MS: manufactured by Hewlett-Packard) using DB-5 (0.25 mmI.D×30 m) as a column and helium as a carrier gas.

Example 1

Kenaf seeds (208 mg) and methanol (1.50 g) (special grade chemical, available from WAKO Pure Chemical Industries, Ltd.) were charged in an autoclave (made of stainless steel SUS 316; internal volume of 4.5 ml) and heated up to 250° C. in a sand bath and maintained at the same temperature for 30 minutes. Then, the autoclave was quenched to room temperature. Thereafter, the reaction liquid was recovered from the autoclave, and quantitatively analyzed by the above method. The intended methyl esters were obtained in an amount of 39 mg, and the amounts of triglyceride, diglyceride and monoglyceride in the reaction liquid were 3 mg, 5 mg and 9 mg respectively.

The above autoclave was not equipped with a pressure gauge. Thus, a pressure gauge was attached to the same autoclave, and the same amount of kenaf seeds and 2.92 g of methanol (containing excessive 1.42 g corresponding to the dead volume of the pressure gauge) were charged in the autoclave and heated up to 250° C. on the sand bath. Then, the pressure was measured. The pressure was 9 MPa, and the pressure in the course of the reaction was estimated at 9 MPa. Therefore, the reaction in this Example was one under the supercritical conditions.

Comparative Example 1

Kenaf seeds (905 mg), methanol (1.81 g) and sodium hydroxide (44 mg) (special grade chemical, available from WAKO Pure Chemical Industries, Ltd.) were charged in an egg-plant flask and maintained in a water bath kept at 50° C. for one hour to carry out the reaction. After cooling to room temperature, the reaction liquid was quantitatively analyzed by the above method. The intended methyl esters were obtained in an amount of less than 3 mg only. The amounts of triglyceride, diglyceride and monoglyceride in the reaction liquid were all less than 3 mg, and thus the fats and oils were scarcely extracted from the seeds of kenaf. The reaction in this Comparative Example was a liquid phase reaction under an atmospheric pressure.

Comparative Example 2

Kenaf seeds (205 mg) were ground with a mortar and charged in an autoclave (made of SUS 316, internal volume of 4.5 ml) together with methanol (1.50 g). The autoclave was heated up to 150° C. in a sand bath and maintained at the same temperature for 30 minutes. Then, the autoclave was quenched to room temperature. Thereafter, the reaction liquid was recovered from the autoclave, and quantitatively analyzed by the above method. The intended methyl esters were obtained in an amount of less than 3 mg only. The amounts of triglyceride, diglyceride and monoglyceride in the reaction liquid were 40 mg, less than 3 mg and less than 3 mg respectively.

The above autoclave was not equipped with a pressure gauge. Thus, a pressure gauge was attached to the same autoclave, and the same amount of kenaf seeds and 2.92 g of methanol (containing excessive 1.42 g corresponding to the dead volume of the pressure gauge) were charged in the autoclave and heated up to 150° C. on the sand bath. Then, the pressure was measured. The pressure was 1 MPa, and the pressure in the course of the reaction was estimated at 1 MPa. Therefore, the reaction in this Comparative Example was not one under the supercritical conditions.

Example 2

Soybean seeds (404 mg) and methanol (1.50 g) were charged in an autoclave (made of stainless steel SUS 316; internal volume of 4.5 ml) and heated up to 200° C. in a sand bath and maintained at the same temperature for 1 hour. Then, the autoclave was quenched to room temperature. Thereafter, the reaction liquid was recovered from the autoclave, and quantitatively analyzed by the above method. The intended methyl esters were obtained in an amount of 36 mg, and the amounts of triglyceride, diglyceride and monoglyceride in the reaction liquid were 13 mg, 16 mg and 14 mg respectively.

The above autoclave was not equipped with a pressure gauge. Thus, a pressure gauge was attached to the same autoclave, and the same amount of soybean seeds and 2.92 g of methanol (containing excessive 1.42 g corresponding to the dead volume of the pressure gauge) were charged in the autoclave and heated up to 200° C. on the sand bath. Then, the pressure was measured. The pressure was 4 MPa, and the pressure in the course of the reaction was estimated at 4 MPa. Therefore, the reaction in this Example was not one under the supercritical conditions.

Example 3

Soybean seeds (496 mg) and methanol (1.50 g) were charged in an autoclave (made of stainless steel SUS 316; internal volume of 4.5 ml) and heated up to 250° C. in a sand bath and maintained at the same temperature for 1 hour. Then, the autoclave was quenched to room temperature. Thereafter, the reaction liquid was recovered from the autoclave, and quantitatively analyzed by the above method. The intended methyl esters were obtained in an amount of 100 mg, and the amounts of triglyceride, diglyceride and monoglyceride in the reaction liquid were all less than 3 mg.

The above autoclave was not equipped with a pressure gauge. Thus, a pressure gauge was attached to the same autoclave, and the same amount of soybean seeds and 2.92 g of methanol (containing excessive 1.42 g corresponding to the dead volume of the pressure gauge) were charged in the autoclave and heated up to 250° C. on the sand bath. Then, the pressure was measured. The pressure was 9 MPa, and the pressure in the course of the reaction was estimated at 9 MPa. Therefore, the reaction in this Example was one under the supercritical conditions.

Comparative Example 3

Soybean seeds (373 mg) were ground with a mortar and charged in an autoclave (made of SUS 316, internal volume of 4.5 ml) together with hexane (1.50 g) (special grade chemical, available from WAKO Pure Chemical Industries, Ltd.). The autoclave was heated up to 150° C. in a sand bath and maintained at the same temperature for 3 hours. Then, the autoclave was quenched to room temperature. Thereafter, the reaction liquid was recovered from the autoclave, and quantitatively analyzed by the above method. The intended methyl esters were obtained in an amount of less than 3 mg only. The amounts of triglyceride, diglyceride and monoglyceride in the reaction liquid were 64 mg, less than 3 mg and less than 3 mg respectively.

The above autoclave was not equipped with a pressure gauge. Thus, a pressure gauge was attached to the same autoclave, and the same amount of soybean seeds and 2.69 g of hexane (containing excessive 1.19 g corresponding to the dead volume of the pressure gauge) were charged in the autoclave and heated up to 150° C. on the sand bath. Then, the pressure was measured. The pressure was less than 0.5 MPa, and the pressure in the course of the reaction was estimated at less than 0.5 MPa.

Example 4

Rape seeds (502 mg) and methanol (1.50 g) were charged in an autoclave (made of stainless steel SUS 316; internal volume of 4.5 ml) and heated up to 350° C. in a sand bath and maintained at the same temperature for 30 minutes. Then, the autoclave was quenched to room temperature. Thereafter, the reaction liquid was recovered from the autoclave, and quantitatively analyzed by the above method. The intended methyl esters were obtained in an amount of 175 mg, and the amounts of triglyceride, diglyceride and monoglyceride in the reaction liquid were all less than 3 mg.

The above autoclave was not equipped with a pressure gauge. Thus, a pressure gauge was attached to the same autoclave, and the same amount of rapeseeds and 2.92 g of methanol (containing excessive 1.42 g corresponding to the dead volume of the pressure gauge) were charged in the autoclave and heated up to 350° C. on the sand bath. Then, the pressure was measured. The pressure was 20 MPa, and the pressure in the course of the reaction was estimated at 20 MPa. Therefore, the reaction in this Example was one under the supercritical conditions.

Comparative Example 4

Rape seeds (501 mg) were ground with a mortar and charged in an autoclave (made of SUS 316, internal volume of 4.5 ml) together with hexane (1.50 g). The autoclave was heated up to 150° C. in a sand bath and maintained at the same temperature for 3 hours. Then, the autoclave was quenched to room temperature. Thereafter, the reaction liquid was recovered from the autoclave, and quantitatively analyzed by the above method. The intended methyl esters were obtained in an amount of less than 3 mg only. The amounts of triglyceride, diglyceride and monoglyceride in the reaction liquid were 173 mg, less than 3 mg and less than 3 mg respectively.

The above autoclave was not equipped with a pressure gauge. Thus, a pressure gauge was attached to the same autoclave, and the same amount of rapeseeds and 2.69 g of hexane (containing excessive 1.19 g corresponding to the dead volume of the pressure gauge) were charged in the autoclave and heated up to 150° C. on the sand bath. Then, the pressure was measured. The pressure was less than 0.5 MPa, and the pressure in the course of the reaction was estimated at less than 0.5 MPa.

Example 5

Rape seeds (610 mg) and methanol (1.76 g) were charged in an autoclave (made of stainless steel SUS 316; internal volume of 4.5 ml) and heated up to 250° C. in a sand bath and maintained at the same temperature for 30 minutes. Then, the autoclave was quenched to room temperature. Thereafter, the reaction liquid was recovered from the autoclave, and quantitatively analyzed by the above method. The intended methyl esters were obtained in an amount of 77 mg, and the amounts of triglyceride, diglyceride and monoglyceride in the reaction liquid were 104 mg, 70 mg and 26 mg respectively.

The above autoclave was not equipped with a pressure gauge. Thus, a pressure gauge was attached to the same autoclave, and the same amount of rapeseeds and 3.18 g of methanol (containing excessive 1.42 g corresponding to the dead volume of the pressure gauge) were charged in the autoclave and heated up to 250° C. on the sand bath. Then, the pressure was measured. The pressure was 9 MPa, and the pressure in the course of the reaction was estimated at 9 MPa. Therefore, the reaction in this Example was one under the supercritical conditions.

Example 6

Rape seeds (614 mg), methanol (1.77 g) and lithium hydroxide monohydrate (special grade chemical, available from WAKO Pure Chemical Industries, Ltd.) (5 mg) were charged in an autoclave (made of stainless steel SUS 316; internal volume of 4.5 ml) and heated up to 250° C. in a sand bath and maintained at the same temperature for 30 minutes. Then, the autoclave was quenched to room temperature. Thereafter, the reaction liquid was recovered from the autoclave, and quantitatively analyzed by the above method. The intended methyl esters were obtained in an amount of 218 mg, and the amounts of triglyceride, diglyceride and monoglyceride in the reaction liquid were less than 3 mg, 5 mg and 12 mg respectively.

The estimated pressure during the reaction was 9 MPa. Therefore, the reaction in this Example was one under the supercritical conditions.

Example 7

Rape seeds (609 mg), methanol (1.76 g) and sodium hydroxide (special grade chemical, available from WAKO Pure Chemical Industries, Ltd.) (1 mg) were charged in an autoclave (made of stainless steel SUS 316; internal volume of 4.5 ml) and heated up to 250° C. in a sand bath and maintained at the same temperature for 30 minutes. Then, the autoclave was quenched to room temperature. Thereafter, the reaction liquid was recovered from the autoclave, and quantitatively analyzed by the above method. The intended methyl esters were obtained in an amount of 117 mg, and the amounts of triglyceride, diglyceride and monoglyceride in the reaction liquid were 40 mg, 36 mg and 27 mg respectively.

The estimated pressure during the reaction was 9 MPa. Therefore, the reaction in this Example was one under the supercritical conditions.

Example 8

Rape seeds (611 mg), methanol (1.76 g) and anhydrous sodium carbonate (special grade chemical, available from WAKO Pure Chemical Industries, Ltd.) (6 mg) were charged in an autoclave (made of stainless steel SUS 316; internal volume of 4.5 ml) and heated up to 250° C. in a sand bath and maintained at the same temperature for 30 minutes. Then, the autoclave was quenched to room temperature. Thereafter, the reaction liquid was recovered from the autoclave, and quantitatively analyzed by the above method. The intended methyl esters were obtained in an amount of 155 mg, and the amounts of triglyceride, diglyceride and monoglyceride in the reaction liquid were 15 mg, 21 mg and 30 mg respectively.

The estimated pressure during the reaction was 9 MPa. Therefore, the reaction in this Example was one under the supercritical conditions.

Example 9

Olive flesh (517 mg) and methanol (1.50 g) were charged in an autoclave (made of stainless steel SUS 316; internal volume of 4.5 ml) and heated up to 250° C. in a sand bath and maintained at the same temperature for 1 hour. Then, the autoclave was quenched to room temperature. Thereafter, the reaction liquid was recovered from the autoclave, and quantitatively analyzed by the above method. The intended methyl esters were obtained in an amount of 66 mg, and the amounts of triglyceride, diglyceride and monoglyceride in the reaction liquid were all 0 mg.

The above autoclave was not equipped with a pressure gauge. Thus, a pressure gauge was attached to the same autoclave, and the same amount of olive flesh and 2.92 g of methanol (containing excessive 1.42 g corresponding to the dead volume of the pressure gauge) were charged in the autoclave and heated up to 250° C. on the sand bath. Then, the pressure was measured. The pressure was 9 MPa, and the pressure in the course of the reaction was estimated at 9 MPa. Therefore, the reaction in this Example was one under the supercritical conditions.

Example 10

Olive flesh (520 mg) and methanol (1.50 g) were charged in an autoclave (made of stainless steel SUS 316; internal volume of 4.5 ml) and heated up to 300° C. in a sand bath and maintained at the same temperature for 30 minutes. Then, the autoclave was quenched to room temperature. Thereafter, the reaction liquid was recovered from the autoclave, and quantitatively analyzed by the above method. The intended methyl esters were obtained in an amount of 68 mg, and the amounts of triglyceride, diglyceride and monoglyceride in the reaction liquid were 0 mg, 0 mg and less than 3 mg respectively.

The estimated pressure during the reaction was 14 MPa. Therefore, the reaction in this Example was one under the supercritical conditions.

Comparative Example 5

Olive flesh (527 mg) and methanol (1.50 g) were charged in an autoclave (made of stainless steel SUS 316; internal volume of 4.5 ml) and heated up to 150° C. in a sand bath and maintained at the same temperature for 30 minutes. Then, the autoclave was quenched to room temperature. Thereafter, the reaction liquid was recovered from the autoclave, and quantitatively analyzed by the above method. The intended methyl esters were obtained in an amount of less than 3 mg only, and the amounts of triglyceride, diglyceride and monoglyceride in the reaction liquid were 25 mg, 0 mg and 0 mg respectively.

The above autoclave was not equipped with a pressure gauge. Thus, a pressure gauge was attached to the same autoclave, and the same amount of olive flesh and 2.92 g of methanol (containing excessive 1.42 g corresponding to the dead volume of the pressure gauge) were charged in the autoclave and heated up to 150° C. on the sand bath. Then, the pressure was measured. The pressure was 1 MPa, and the pressure in the course of the reaction was estimated at 1 MPa. Therefore, the reaction in this Example was not one under the supercritical conditions.

Comparative Example 6

Olive flesh (512 mg) were ground with a mortar and charged in an autoclave (made of SUS 316, internal volume of 4.5 ml) together with hexane (special grade chemical, available from WAKO Pure Chemical Industries, Ltd.) (1.50 g). The autoclave was heated up to 150° C. in a sand bath and maintained at the same temperature for 3 hours. Then, the autoclave was quenched to room temperature. Thereafter, the reaction liquid was recovered from the autoclave, and quantitatively analyzed by the above method. The intended methyl esters were obtained in an amount of less than 3 mg only. The amounts of triglyceride, diglyceride and monoglyceride in the reaction liquid were 68 mg, 0 mg and less than 3 mg respectively.

The estimated pressure during the reaction was 0.5 MPa.

What is claimed is:

1. A method for preparing a fatty acid ester comprising treating at least one of botanical seeds and fruits with a monohydric alcohol of the formula:

$$R—OH \quad (1)$$

wherein R is an alkyl group having 1 to 10 carbon atoms under pressure at a temperature of at least 180° C.

2. The method according to claim 1, wherein a pressure is at least 2 MPa.

3. The method according to claim 1, wherein the treatment is carried out under conditions wherein said monohydric alcohol is in a supercritical state.

4. The method according to claim 1, wherein said monohydric alcohol is methanol.

5. The method according to claim 1, wherein said botanical seeds are seeds of at least one plant selected from the group consisting of soybean, rape and kenaf.

6. The method according to claim 1, wherein said botanical fruits are fruits of at least one plant selected from the group consisting of olive and palm.

7. The method according to claim 1, wherein the treatment is carried out in the presence of at least one catalyst selected from the group consisting of hydroxides and carbonates of alkali metals.

* * * * *